US010700467B2

(12) United States Patent
Chikusa

(10) Patent No.: US 10,700,467 B2
(45) Date of Patent: Jun. 30, 2020

(54) CONNECTOR

(71) Applicant: Sumitomo Wiring Systems, Ltd., Yokkaichi, Mie (JP)

(72) Inventor: Takahiro Chikusa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/267,759

(22) Filed: Feb. 5, 2019

(65) Prior Publication Data

US 2019/0267746 A1 Aug. 29, 2019

(30) Foreign Application Priority Data

Feb. 26, 2018 (JP) ..... 2018-031437

(51) Int. Cl.
*H01R 13/50* (2006.01)
*H01R 13/506* (2006.01)
*H01R 13/422* (2006.01)

(52) U.S. Cl.
CPC ..... *H01R 13/506* (2013.01); *H01R 13/422* (2013.01); *H01R 13/4223* (2013.01)

(58) Field of Classification Search
CPC . H01R 13/506; H01R 13/422; H01R 13/4223
See application file for complete search history.

(56) References Cited

U.S. PATENT DOCUMENTS 6,752,660 B2 * 6/2004 Fujita ..... H01R 13/113 439/595
7,632,158 B2 * 12/2009 Denpouya ..... H01R 13/4367 439/488
8,721,374 B2 * 5/2014 Glick ..... H01R 13/426 439/596
8,784,141 B2 * 7/2014 Ishikawa ..... H01R 43/20 439/595
2016/0365663 A1 * 12/2016 Chikusa ..... H01R 13/4223

FOREIGN PATENT DOCUMENTS

JP 2017-4736 1/2017

* cited by examiner

*Primary Examiner* — Alexander Gilman
(74) *Attorney, Agent, or Firm* — Gerald E. Hespos; Michael J. Porco; Matthew T. Hespos

(57) ABSTRACT

It is aimed to enable the present or absence of an incompletely inserted state to be detected in a stacked connector. A connector (1) is provided with retaining portions (27, 57) for deflecting a second base portion (45) of a second housing (3) outward in a stacking direction when a first housing (2) and the second housing (3) are locked in a state where a female terminal fitting (80) in an incompletely inserted state is present. Further, the second base (45) is provided with a detection rib (71) in a part easily deflected when the first and second housings (2, 3) are locked to each other. The detection rib (71) is formed to project downward from the lower surface of the second base (45).

7 Claims, 14 Drawing Sheets

CONNECTOR

BACKGROUND

Field of the Invention

The invention relates to a connector.

Related Art

Japanese Unexamined Patent Publication No. 2017-4736 describes a stacked connector obtained by assembling plate-like housings in a state stacked one on another. Each housing of this connector includes terminal accommodation chambers for accommodating terminal fittings and retaining portions projecting toward the terminal accommodation chambers of an overlapping mating housing. The terminal fitting is formed with a groove into which the retaining portion is to be fit. The retaining portions fit in the grooves of the terminal fittings accommodated in the terminal accommodation chambers of the mating housings to prevent the escape of the terminal fittings in a direction perpendicular to a stacking direction when the housings overlap each other. Further, unlike a locking lance configured to be resiliently deformed and catch a terminal fitting, this retaining portion is not deflected in a direction to release a locking state. Thus, in this connector, a retainer or the like need not be mounted separately to prevent the locking state from being released.

This connector generally is delivered with the terminal fittings inserted to proper positions in the housings. Accordingly, if the connector is delivered with the terminal fitting incompletely inserted, a worker may assemble a product in a wrong state without noticing the incompletely inserted terminal fitting. Thus, it is desired to reliably detect whether or not any terminal fitting is in an incompletely inserted state before delivery.

The invention was completed in view of the above conventional situation and aims to detect the presence or absence of an incompletely inserted state in a stacked connector.

SUMMARY

The invention is directed to a connector with housings each including a base in the form of a flat plate. The housings are assembled in a stacked state. Terminal accommodating portions are formed in the housing and are configured to accommodate terminal fittings in parallel in a width direction along the base. A holding portion is configured to hold the housings in the stacked state. Retaining portions are provided in at least one of the housings and are configured to prevent the escape of the terminal fittings inserted into another housing overlapping in the stacked state. A detection rib is disposed at a position distant from the holding portion in an arrangement direction of the terminal fittings and projects outward in a stacking direction from an outermost surface. The outermost surface is an outer surface in the stacking direction of the base of the outermost housing in the stacking direction. The detection rib protrudes out in the stacking direction by the base formed with the detection rib being deflected out in the stacking direction when the terminal fitting in an incompletely inserted state and the retaining portion interfere with each other.

The base of the outermost housing in the stacking direction is deflected out in the stacking direction due to the interference of the terminal fitting and the retaining portion. At this time, the detection rib protrudes out in the stacking direction as compared to the case where the terminal fitting and the retaining portion do not interfere with each other. Thus, whether or not any terminal fitting is inserted incompletely can be detected by confirming whether or not the detection rib is protruding.

The outermost housing in the stacking direction may be formed with a front wall in the form of a rib rising from a front part of the base and configured to restrict forward movements of the terminal fittings accommodated in the terminal accommodation chambers. The detection rib may be provided on a rear end part of the base.

Since the outermost housing in the stacking direction is formed with the front wall in the form of a rib rising from the front edge part of the base, a part of the base on a front end has high rigidity. In contrast, a rear end part of the base has lower rigidity than the front part and is deflected easily. However, the detection rib at this easily deflected position prevents improper deformation of the terminal fitting and the retaining portion during interference.

The base of the outermost housing is formed with a guide rib disposed substantially on an extension of the holding portion in the stacking direction and projecting outward in the stacking direction from the outermost surface. Further, a projecting end surface of the guide rib in the stacking direction is aligned in the stacking direction with a projecting end surface of the detection rib in the stacking direction or is located farther out in the stacking direction than the projecting end surface of the detection rib in the stacking direction.

In this configuration, the projecting end surface of the detection rib in the stacking direction is aligned in the stacking direction with the projecting end surface of the guide rib in the stacking direction or is retracted more inwardly in the stacking direction than the projecting end surface of the guide rib in the stacking direction in a state where the base of the outermost housing is not deflected out in the stacking direction. In contrast, the projecting end surface of the detection rib in the stacking direction protrudes farther out in the stacking direction than the projecting end surface of the guide rib in the stacking direction in a state where the base of the outermost housing is deflected outward in the stacking direction. Thus, if a checking tool is moved horizontally toward the detection rib while sliding on the projecting end surface of the guide rib in the stacking direction, whether or not any terminal fitting is inserted incompletely can be detected based on whether or not the checking tool has contacted the detection rib. By setting the projecting end surface of the guide rib in the stacking direction as a reference position in this way, the incompletely inserted state of the terminal fitting can be detected easily and precisely.

DETAILED DESCRIPTION

Figure 9:
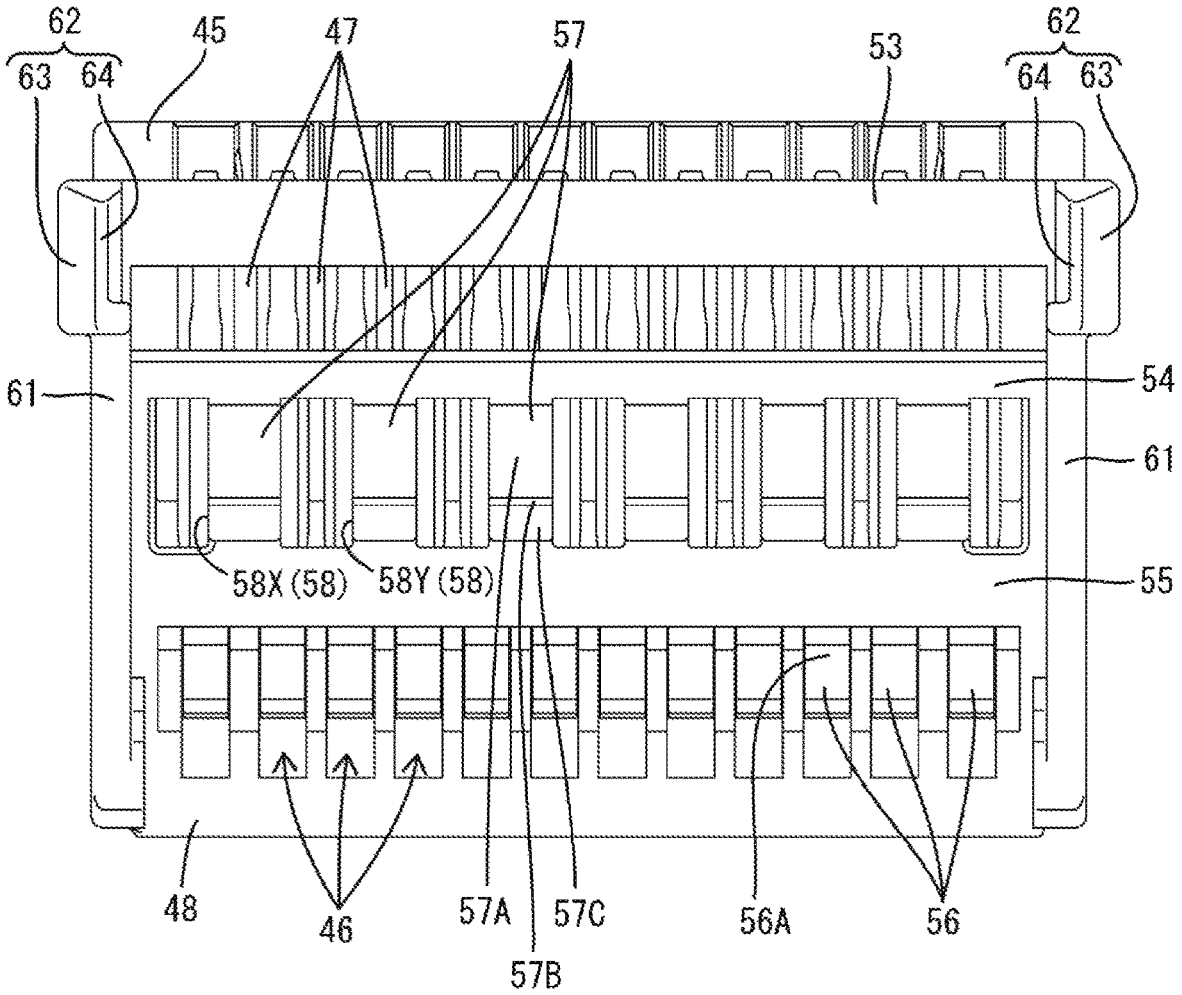
FIG. 9 is a plan view of the second housing.
Figure 10:
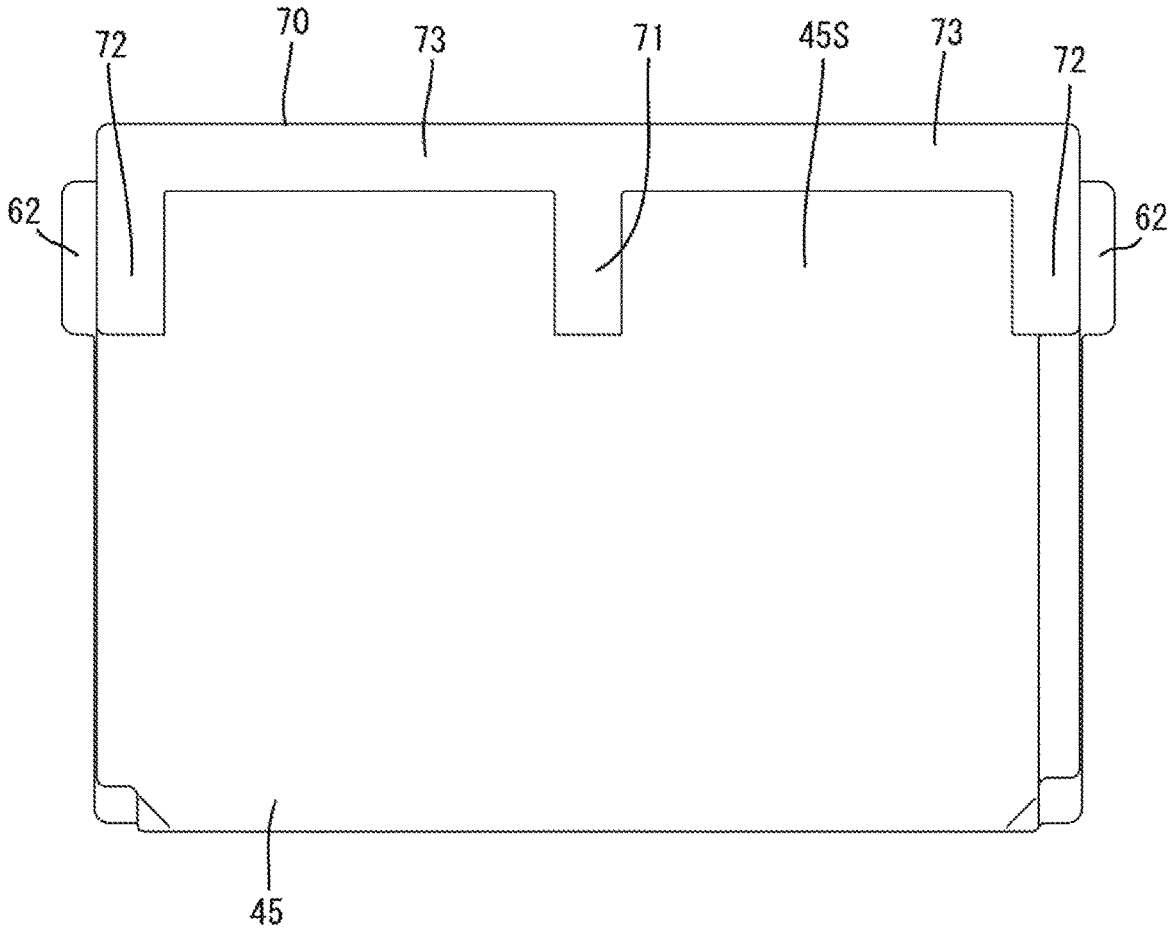
FIG. 10 is a bottom view of the second housing.
Figure 11:
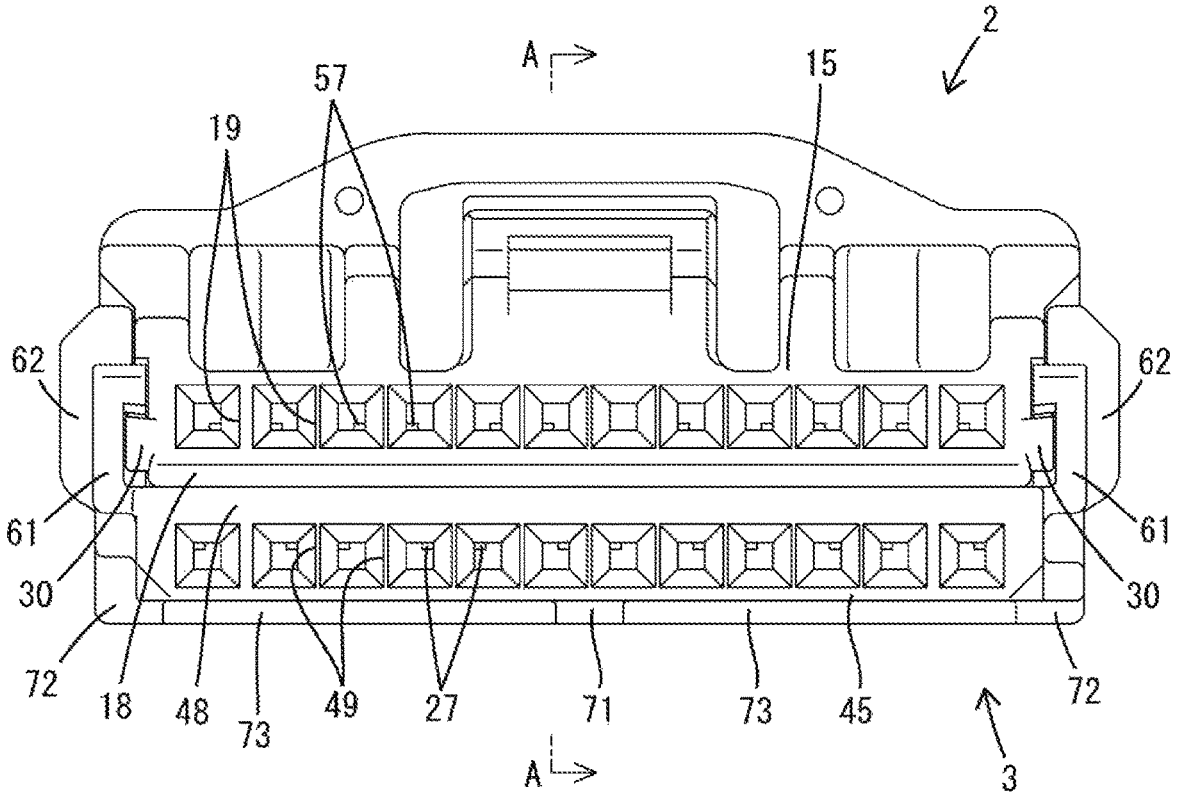
FIG. 11 is a front view of the connector.
Figure 12:
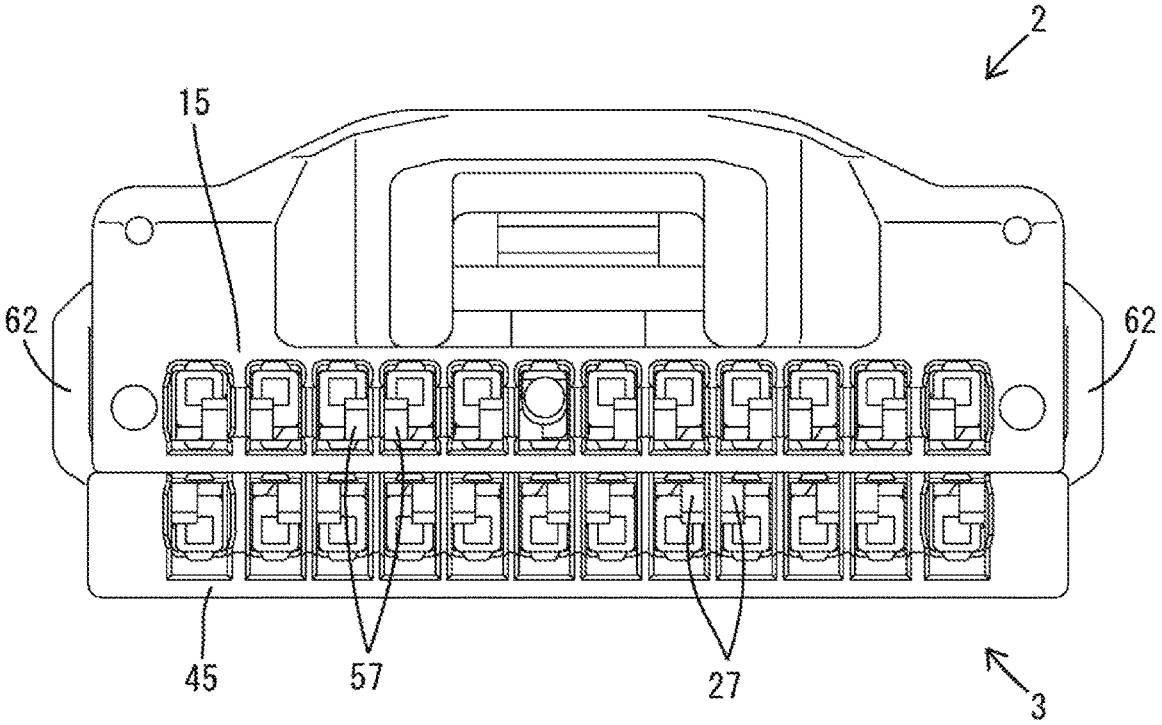
FIG. 12 is a back view of the connector.

An embodiment of the invention is described with reference to FIGS. 1 to 16. Note that, in the following description, a lower side in FIGS. 5, 9 and 10 and a left side (side to be connected to an unillustrated mating connector) are defined as a front concerning a front-rear direction. A stacking direction of housings 2, 3 is defined as the vertical direction. Specifically, a vertical direction shown in FIGS. 3, 4, 7, 8 and 11 to 16 is defined as the vertical direction. A direction perpendicular to the vertical direction and the front-rear direction is defined as the lateral direction.

<Connector 1>

Figure 1:
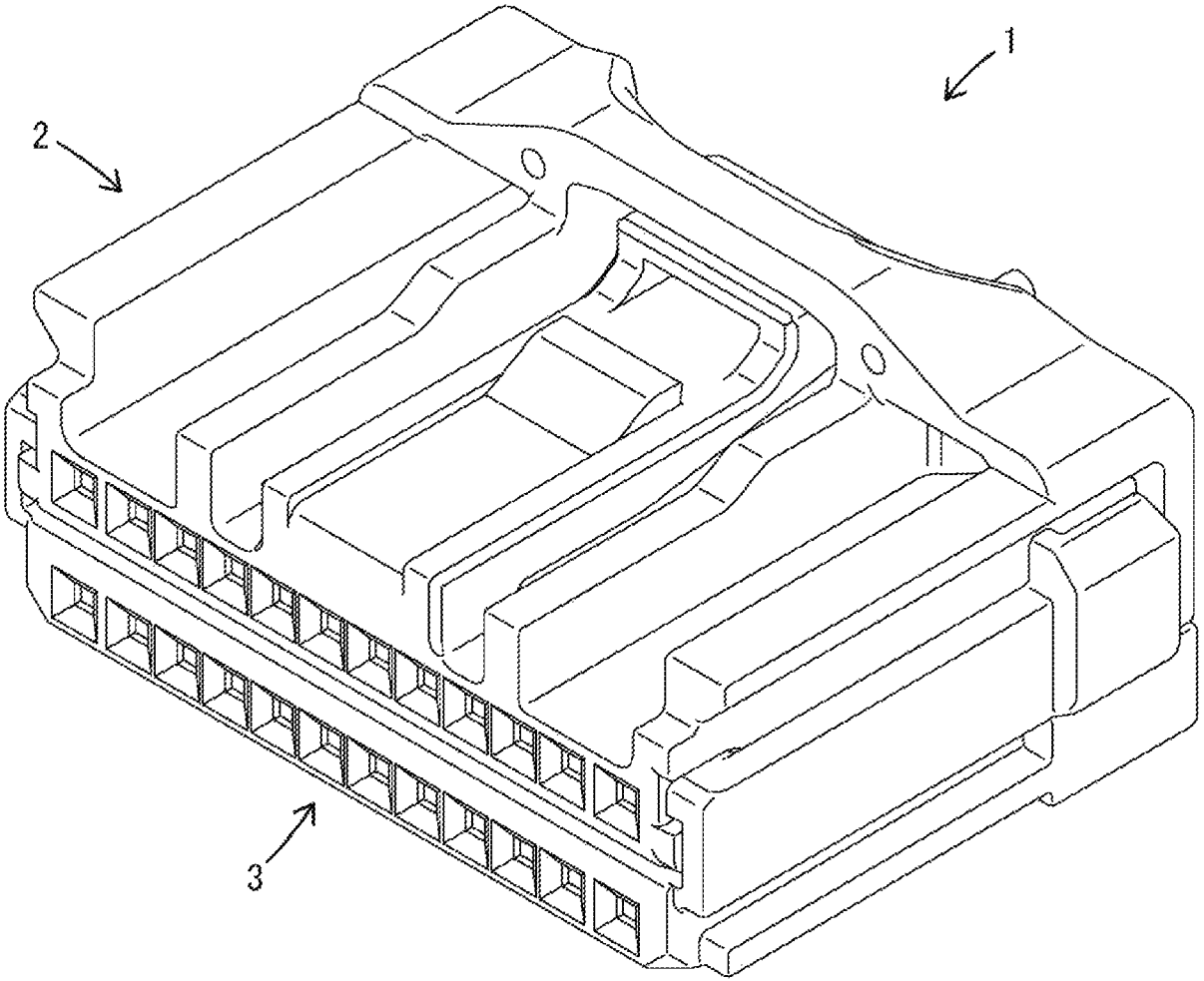
FIG. 1 is a perspective view of a connector of one embodiment obliquely viewed from front.

A connector 1 of this embodiment is configured by assembling the housings 2, 3 in a state stacked one on the other as shown in FIG. 1. The connector 1 has a substantially rectangular shape long in the lateral direction in a plan view and has a flat shape long in the lateral direction in a front view. Each housing 2, 3 is made of synthetic resin and has a flat shape long in the lateral direction in a front view.

<First Housing 2>

As shown in FIGS. 2 to 5, the first housing 2 includes a first terminal accommodating portion 10 for accommodating female terminal fittings 80, a lock arm 11 formed on the upper surface of the first terminal accommodating portion 10, erroneous connection preventing ribs 12 formed on the upper surface of the first terminal accommodating portion 10 at left and right sides of the lock arm 11 and a bridge 13 disposed on the upper surfaces of rear end parts of the erroneous connection preventing ribs 12.

The first terminal accommodating portion 10 has a flat shape long in the lateral direction in a front view. The first terminal accommodating portion 10 includes a first base 15 in the form of a flat plate. First terminal accommodation chambers 16 are formed below the first base 15 (on the side of the second housing 3) are capable of individually accommodating the female terminal fittings 80. Each first terminal accommodation chamber 16 is elongated in the front-rear direction. Adjacent ones of the first terminal accommodation chambers 16 are partitioned by first partition walls 17 extending down (toward the second housing 3) from the lower surface (surface on the side of the second housing 3) of the first base 15. The female terminal fittings 80 are accommodated in parallel in a width direction (lateral direction in this embodiment) along the lower surface (surface on the side of the second housing 3) of the first base 15.

The first terminal accommodation chamber 16 is open rearward and the female terminal fitting 80 is inserted therein from behind. The female terminal fitting 80 accommodated in the first terminal accommodation chamber 16 has a forward movement restricted by a first front wall 18. The first front wall 18 is a rib projecting down (toward the second housing 3) from the front edge of the first base 15 and extending in the lateral direction. The first front wall 18 projects substantially perpendicular to the first base 15 and is continuous over the entire width of the first base 15. One first front wall 18 closes the front ends of all the first terminal accommodation chambers 16.

First tab insertion openings 19 are open in the front surface of the first front wall 18. Each first tab insertion opening 19 communicates with the front of the first terminal accommodation chamber 16. A male tab of an unillustrated mating male terminal fitting is insertable into the first tab insertion opening 19. The female terminal fitting 80 can contact the male tab inserted into the first terminal accommodation chamber 16 through the first tab insertion opening 19 and is connected electrically by contacting the male tab.

First side walls 20 project down (toward the second housing 3) from both left and right sides of the first base 15 of the first terminal accommodating portion 10 and extend in the front-rear direction. The front ends of the first side walls 20 are continuous with both left and right end edges of the first front wall 18.

Figure 5:
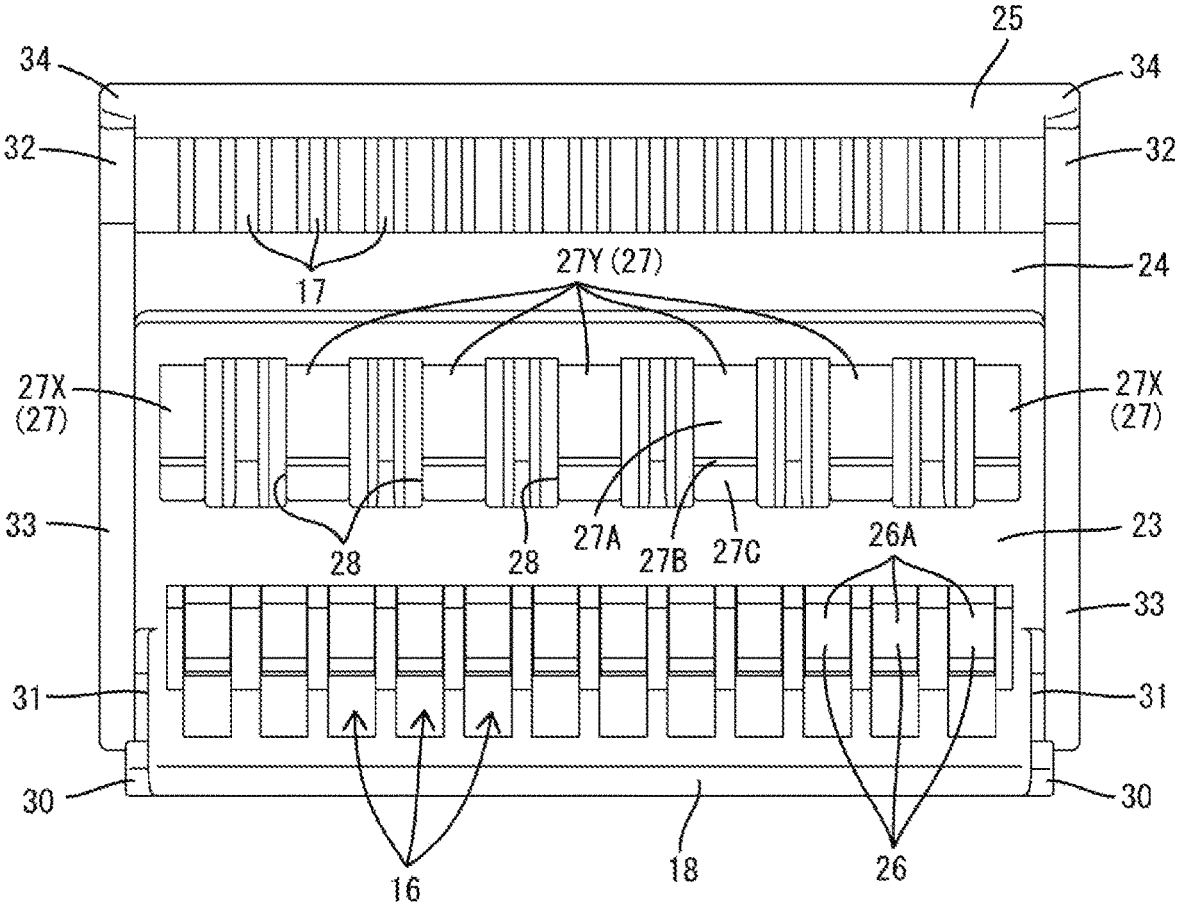
FIG. 5 is a bottom view of the first housing.
Figure 6:
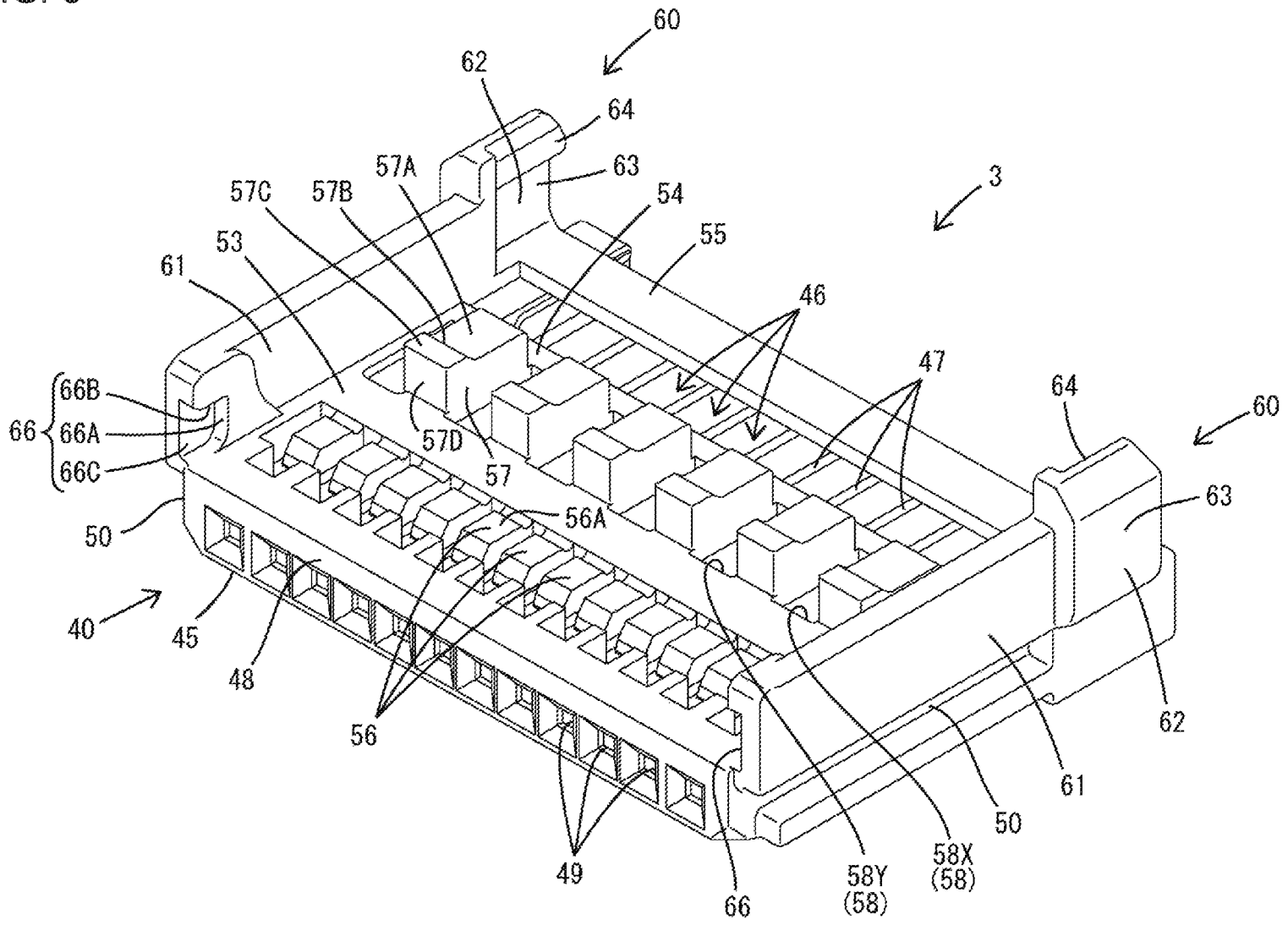
FIG. 6 is a perspective view of a second housing obliquely viewed from front.
Figure 7:
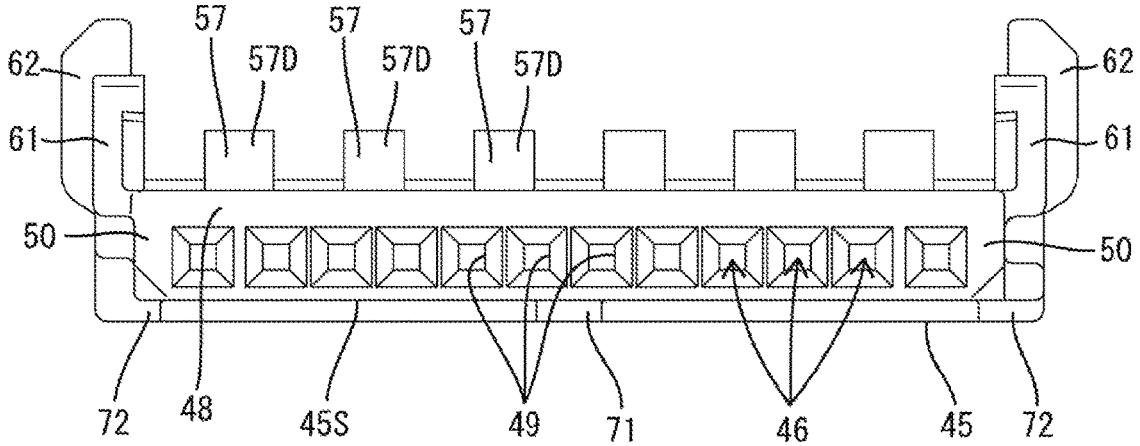
FIG. 7 is a front view of the second housing.
Figure 8:
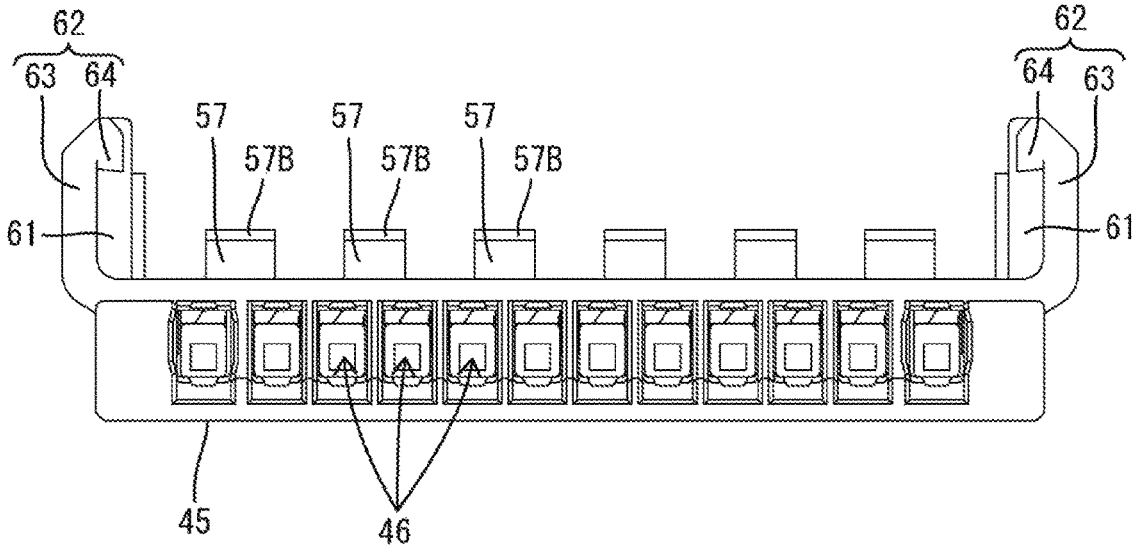
FIG. 8 is a back view of the second housing.

First beams 23, 24 and 25 are provided on lower sides (on the side of the second housing 3) of the first terminal accommodation chambers 16 and link the first side walls 20 on the left and right sides, as shown in FIG. 5. The first beams 23, 24 and 25 extend in an arrangement direction of the first terminal accommodation chambers 16. The first beams 23, 24 and 25 are disposed successively from a rear of the first terminal accommodating portion 10 toward the first front wall 18. Clearances are formed between the first front wall 18 and the first front beam 23, between the first front beam 23 and the first rear beam 24 and between the first rear beam 24 and the first rear end beam 25.

Note that partitioning portions partitioning on both left and right side parts and an upper end part and between the first tab insertion openings 19 in the first front wall 18 are thicker than the first partition walls 17 and the first beams 23, 24 and 25.

The first terminal accommodating portion 10 is formed with first locking lances 26 cantilevered forward from the front of the first front beam 23. The first locking lance 26 can prevent the rearward escape of the female terminal fitting 80 by resiliently catching the female terminal fitting 80 inserted into the first terminal accommodation chamber 16. The first locking lances 26 correspond to the respective first terminal accommodation chambers 16. When the female terminal fitting 80 is inserted into the first terminal accommodation chamber 16, the first locking lance 26 is pressed by the female terminal fitting 80 to deform resiliently. When the female terminal fitting 80 is further inserted and reaches a proper position, the female terminal fitting 80 and the first locking lance 26 no longer interfere with each other. Thus, the first locking lance 26 resiliently returns. In this way, the female terminal fitting 80 is caught by the first locking lance 26 and cannot escape rearward. The lower surface (surface on a side opposite to the first terminal accommodation chamber 16, surface on the side of the second housing 3) of the first locking lance 26 is formed with a first back contact surface 26A extending substantially in a horizontal direction.

The first terminal accommodating portion 10 is formed with first retaining portions 27 coupling the first front beam 23 and the first rear beam 24. The first retaining portion 27 is substantially in the form of a block projecting down (toward the second housing 3) from a coupling part of the first front beam 23 and the first rear beam 24. The respective first retaining portions 27 are disposed at constant intervals from each other in the arrangement direction of the first terminal accommodation chambers 16 (lateral direction in this embodiment). The interval between the first retaining portions 27 is equal to or larger than a width of the second retaining portions 57 to be described later.

The upper surfaces (surfaces on the side of the first terminal accommodation chambers 16) of the respective first retaining portions 27 are flush with the upper surface (surface on the side of the first terminal accommodation chambers 16) of the first front beam portion 23 and also flush with the upper surface (surface on the side of the first terminal accommodation chambers 16) of the first rear beam 24.

Each first retaining portion 27 projects farther down (toward the second housing 3) than the lower surfaces (surfaces on the side of the second housing 3) of the first beam portions 23, 24 and 25 and is exposed downward (toward the second housing 3). The lower surface (surface on the side of the second housing 3) of the first retaining portion 27 has a first interfering rear surface 27A, a first interfering connecting surface 27B and a first interfering front surface 27C. The first interfering rear surface 27A constitutes a rear part of the lower surface of the first retaining portion 27 and extends along a substantially horizontal direction. The first interfering front surface 27C constitutes a front part of the lower surface of the first retaining portion 27, is disposed below (closer to the second housing 3) the first interfering rear surface 27A and extends along a substantially horizontal direction. The first interfering connecting surface 27B is continuous with the front of the first interfering rear surface 27A and the rear end edge of the first interfering front surface 27C, and is inclined down (toward the second housing 3) from the rear to the front.

The front surface of the first retaining portion 27 constitutes a first restricting surface 27D and extends substantially vertically. The front surface of the first retaining portion 27 is aligned with the rear surface of the first front beam 23 in the front-rear direction or disposed behind the rear surface of the first front beam 23. The rear surface of the first retaining portion 27 is aligned with the front surface of the first rear beam 24 in the front-rear direction or disposed before the front surface of the first rear beam 24.

The first retaining portions 27 are composed of two first one-side retaining portions 27X disposed on both lateral ends and first both-side retaining portions 27Y disposed between the two first one-side retaining portions 27X. The first one-side retaining portions 27X differ from the first both-side retaining portions 27Y in having a smaller lateral width than the first both-side retaining portions 27Y.

A first insertion hole 28 into which the second retaining portion 57 to be described later is to be inserted is formed between adjacent two first retaining portions 27. The second retaining portion 57 can be inserted into the first terminal accommodation chamber 16 through the first insertion hole 28. The first insertion hole 28 is formed such that adjacent two first terminal accommodation chambers 16 can be seen from below. Thus, one second retaining portion 57 can be inserted into adjacent two first terminal accommodation chambers 16 through the first insertion hole 28.

Figure 2:
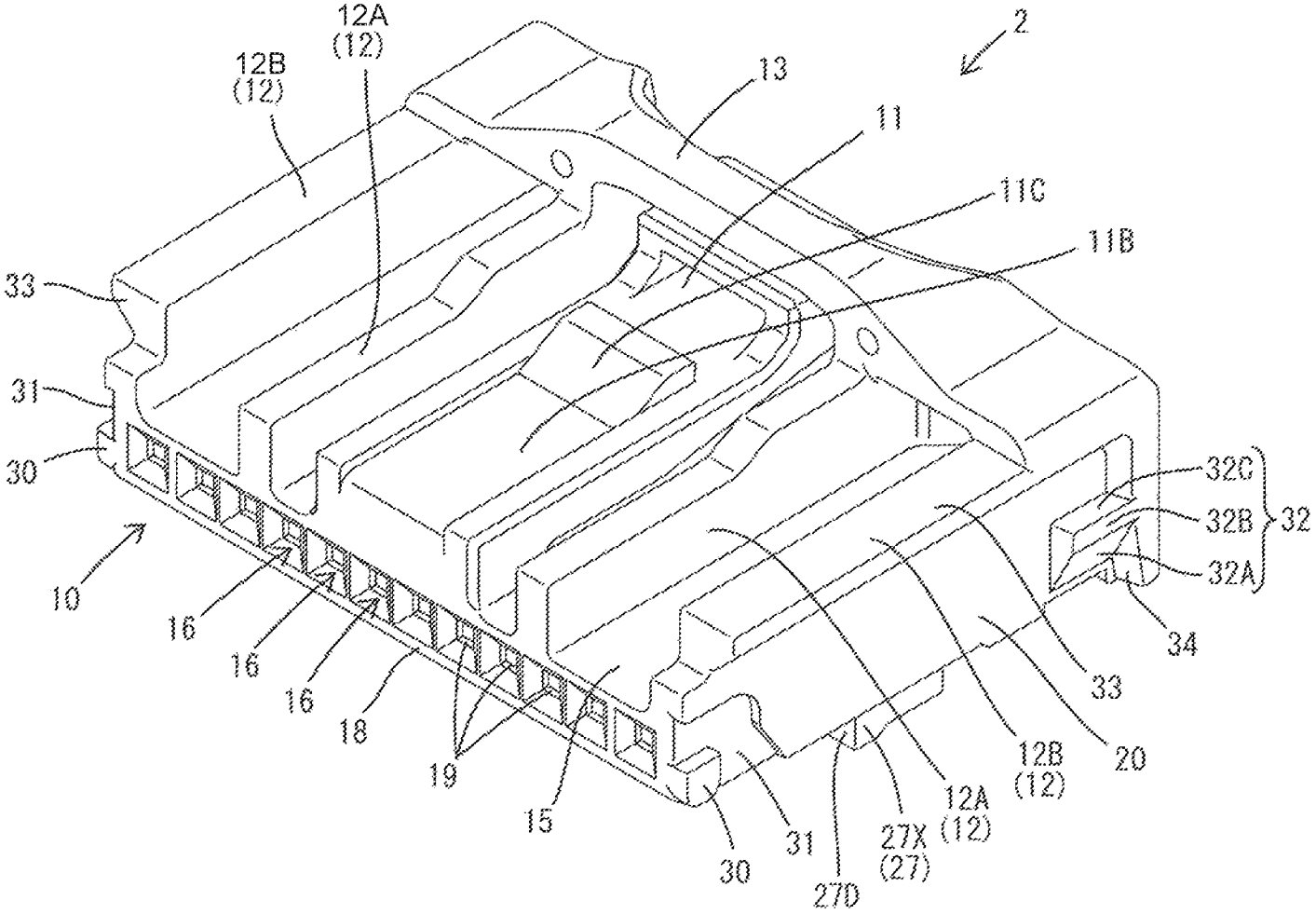
FIG. 2 is a perspective view of a first housing obliquely viewed from front.
Figure 3:
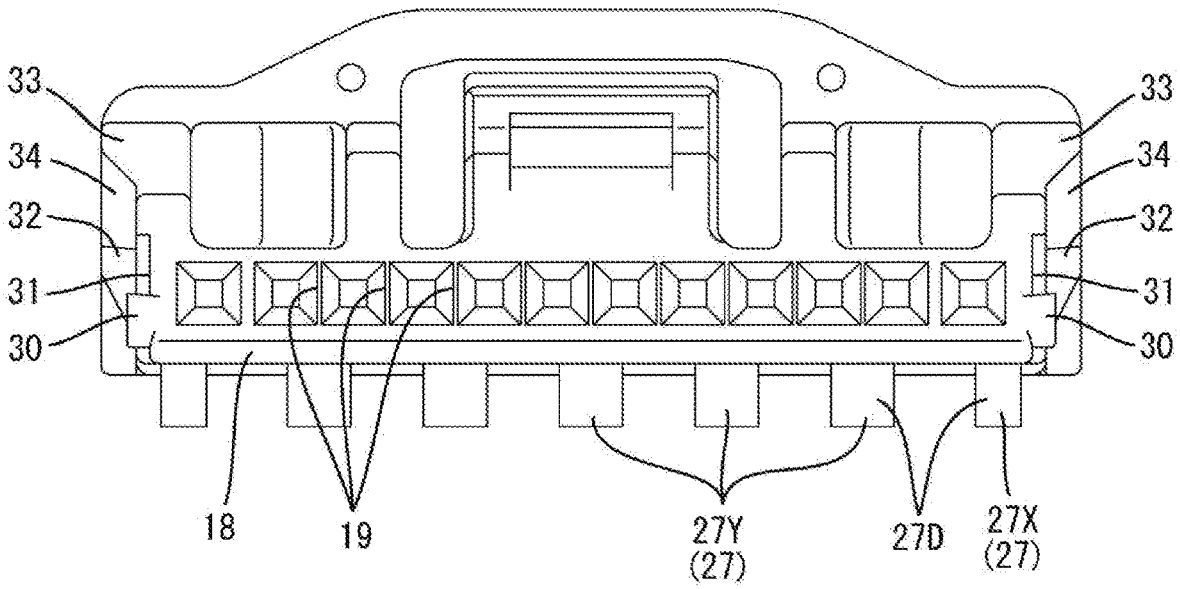
FIG. 3 is a front view of the first housing.
Figure 4:
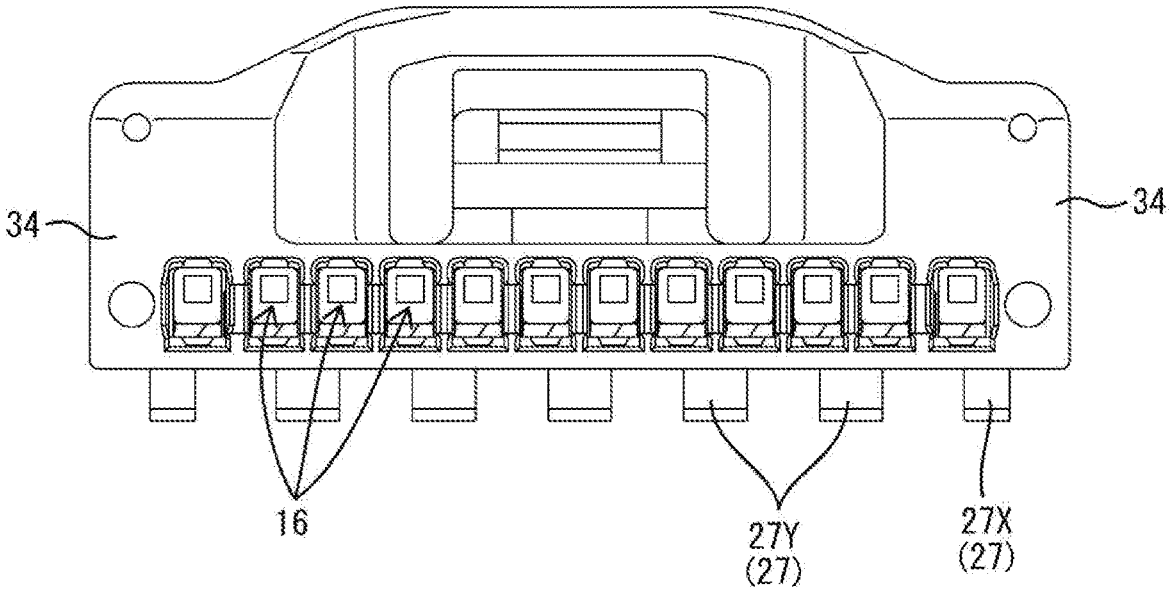
FIG. 4 is a back view of the first housing.

As shown in FIGS. 2 and 3, rotary shafts 30 project laterally out on lower end parts of front parts of both left and right side surfaces of the first housing 2 (first terminal accommodating portion 10). A substantially lower half of the rotary shaft 30 has a semi-elliptical shape and an upper half thereof has a rectangular shape in a side view. The upper surface of the rotary shaft 30 is substantially horizontal.

Fitting grooves 31 are formed by recessing the both left and right side surfaces of the first housing 2 (first terminal accommodating portion 10) laterally inwardly around the rotary shafts 30. A part of the fitting groove 31 located behind the rotary shaft 30 is open downward. A part of the fitting groove 31 located above the rotary shaft 30 is open forward. A rotary shaft bearing 66 to be described later can be fit into the fitting groove 31.

Lock receiving portions 32 to be locked by being caught by lock plates 62 of the second housing 3 to be described later are formed on rear end parts of the left and right side surfaces of the first housing 2 (first terminal accommodating portion 10). A lateral outer side surface of the lock receiving portion 32 has an inclined surface 32A inclined laterally out toward an upper side from a lower end in a front view and a slipping surface 32B extending along a substantially vertical direction from the upper end edge of this inclined surface 32B. The upper end edge of this slipping surface 32B is continuous with a receiving surface 32C constituting the upper surface of the lock receiving portion 32. The receiving surface 32C extends substantially horizontally. The first retaining portions 27 are located before the lock receiving portions 32 and behind the first front wall 18 in the front-rear direction.

Upper end ribs 33 project laterally out from upper parts of the left and right side surfaces of the first housing 2 and extend in the front-rear direction. The upper end ribs 33 extend from a front part slightly behind the front end to the rear end of the first housing 2.

Rear end ribs 34 project laterally out on the rear end edges of the left and right side surfaces of the first housing 2 and extend vertically. The rear end ribs 34 are formed in the entire vertical areas of the left and right side surfaces. The upper edges of the rear end ribs 34 are continuous with the rear end edges of the upper end ribs 33. The front surfaces of the rear end ribs 34 are continuous with the rear end surfaces of the lock receiving portions 32.

The lock arm 11 projects up from the upper surface of the first terminal accommodating portion 10 (first base 15) in a laterally central part. The lock arm 11 can effect locking by catching a receiving portion (not shown) of the mating connector. The lock arm 11 includes a support 11A rising from a front part of the laterally central part of the upper surface of the first terminal accommodating portion 10, an extending portion 11B cantilevered rearward from an upper end part of the support 11A, and a lock piece 11C projecting out in the stacking direction (up in this embodiment) from the upper surface of the extending portion 11B.

The erroneous connection preventing ribs 12 rise from the upper surface of the first terminal accommodating portion 10 and extend in the front-rear direction. Two outer erroneous connection preventing ribs 12A rise from both left and right end edges of the first terminal accommodating portion 10 and two inner erroneous connection preventing ribs 12B are disposed between each outer erroneous connection preventing rib 12A and the lock arm 11 are provided as the erroneous connection preventing ribs 12. The front surface of each erroneous connection preventing rib 12 is flush with the front surface of the first terminal accommodating portion 10. Each erroneous connection preventing rib 12 is formed over the entire area in the front-rear direction of the first terminal accommodating portion 10. The upper end ribs 33 project laterally out from the upper ends of lateral outer side surfaces of the outer erroneous connection preventing ribs 12A.

The bridge 13 is disposed on the upper surfaces of the rear end parts of the erroneous connection preventing ribs 12 to link all the erroneous connection preventing ribs 12 disposed side by side in the lateral direction. The bridge 13 can restrict a movement in a connecting direction by the front end surface thereof coming into contact with a part of the mating connector (not shown) when the connector 1 is connected to the mating connector.

<Second Housing 3>

The second housing 3 is assembled with the first housing 2 from below the first housing 2. As shown in FIGS. 6 to 10, the second housing 3 includes a second terminal accommodating portion 40 for accommodating female terminal fittings 80 and side plates 60 rising from both left and right edges of the second terminal accommodating portion 40 and extending in the front-rear direction.

The second terminal accommodating portion 40 has substantially the same shape (substantially vertically symmetrical shape) and substantially the same size as the first terminal accommodating portion 10 except that the number and arrangement of the second retaining portions 57 are different from those of the first retaining portions 27. The second terminal accommodating portion 40 has a flat shape long in the lateral direction in a front view. The second terminal accommodating portion 40 includes a second base 45 in the form of a flat plate. Second terminal accommodation chambers 46 are formed above (on the side of the first housing 2) the second base 45 and can individually accommodate the female terminal fittings 80. Each second terminal accommodation chamber 46 is elongated in the front-rear direction. Adjacent second terminal accommodation chambers 46 are partitioned by second partition walls 47 extending up (toward the first housing 2) from the upper surface of the second base 45. The female terminal fittings 80 are accommodated in parallel in the width direction along the upper surface (surface on the side of the first housing 2) of the second base 45.

The second terminal accommodation chamber 46 is open rearward and the female terminal fitting 80 is inserted therein from behind. The female terminal fitting 80 accommodated in the second terminal accommodation chamber 46 has a forward movement restricted by a second front wall 48. The second front wall 48 is a rib projecting up toward the first housing 2 from the front of the second base 45 and extends in the lateral direction. The second front wall 48 projects in a direction substantially perpendicular to the second base 45 and is continuous over the entire width of the second base 45. One second front wall 48 closes the front ends of all of the second terminal accommodation chambers 46.

Second tab insertion openings 49 are open in the front surface of the second front wall 48. Each second tab insertion opening 49 communicates with the front end of the second terminal accommodation chamber 46. A male tab of an unillustrated mating male terminal fitting is insertable into the second tab insertion opening 49. The female terminal fitting 80 is connected electrically to the male tab when contacting the male tab inserted into the second terminal accommodation chamber 46 through the second tab insertion opening 49.

Second side walls 50 project up toward the first housing 2 from both left and right sides of the second base 45 and extend in the front-rear direction. The front ends of the second side walls 50 are continuous with both left and right ends of the second front wall 48.

Second beams 53, 54 and 55 are provided on upper sides of the second terminal accommodation chambers 46 and link the second side walls 50 on both left and right sides. The second beams 53, 54 and 55 extend in an arrangement direction of the second terminal accommodation chambers 46. The second beams 53, 54 and 55 are disposed successively from a rear end part of the second terminal accommodating portion 40 toward the front (toward the second front wall 48). Clearances are formed between the second front wall 48 and the second front beam 53, between the second front beam 53 and the second rear beam 54 and between the second rear beam 54 and the second rear end beam 55.

Partitioning portions partitioning on both left and right side parts and an upper end part and between the second tab insertion openings 49 in the second front wall 48 are formed thicker than the second partition walls 47 and the second beams 53, 54 and 55.

Second locking lances 56 cantilever forward from the front surface of the second front beam 53 of the second terminal accommodating portion 40. Each second locking lance 56 prevents the rearward escape of the female terminal fitting 80 by resiliently catching the female terminal fitting 80 inserted into the second terminal accommodation chamber 46. The second locking lances 56 correspond to the respective second terminal accommodation chambers 46. When the female terminal fitting 80 is inserted into the second terminal accommodation chamber 46, the second locking lance 56 is pressed by the female terminal fitting 80 to deform resiliently. When the female terminal fitting 80 is inserted farther and reaches a proper position, the female terminal fitting 80 and the second locking lance 56 no longer interfere, and the second locking lance 56 resiliently returns. In this way, the female terminal fitting 80 is caught by the second locking lance 56 and cannot escape rearward. The upper surface (surface on a side opposite to the second terminal accommodation chamber 46, surface on the side of the first housing 2) of the second locking lance 56 is formed with a second back contact surface 56A extending substantially horizontally.

The second terminal accommodating portion 40 is formed with the second retaining portions 57 coupling the second front beam 53 and the second rear beam 54. The second retaining portion 57 is a block projecting up (toward the first housing 2) from a coupling of the second front beam 53 and the second rear beam 54. The second retaining portions 57 are disposed at constant intervals from each other in the arrangement direction of the second terminal accommodation chambers 46 (lateral direction in this embodiment). The interval between the second retaining portions 57 is equal to or larger than a width of the first retaining portions 27.

The lower surfaces (surfaces on the side of the second terminal accommodation chambers 46) of the respective second retaining portions 57 are flush with the lower surface (surface on the side of the second terminal accommodation chambers 46) of the second front beam 53 and also flush with the lower surface of the second rear beam 54.

Each second retaining portion 57 projects further upward (toward the first housing 2) than the upper surfaces (surfaces on the side of the first housing 2) of the second beam portions 53, 54 and 55 and is exposed upward (toward the first housing 2). The upper surface (surface on the side of the first housing 2) of the second retaining portion 57 has a second interfering rear surface 57A, a second interfering connecting surface 57B and a second interfering front surface 57C. The second interfering rear surface 57A constitutes a rear end part of the upper surface of the second retaining portion 57 and extends along a substantially horizontal direction. The second interfering front surface 57C constitutes a front end part of the upper surface of the second retaining portion 57, is disposed above (closer to the first housing 2) the second interfering rear surface 57A and extends along a substantially horizontal direction. The second interfering connecting surface 57B is continuous with the front end edge of the second interfering rear surface 57A and the rear end edge of the second interfering front surface 57C, and inclined upward (toward the first housing 2) from rear to front.

The front surface of the second retaining portion 57 constitutes a second restricting surface 57D and extends along a substantially vertical direction. The front surface of the second retaining portion 57 is aligned with the rear surface of the second front beam portion 53 in the front-rear direction or disposed behind the rear surface of the second front beam portion 53. The rear surface of the second retaining portion 57 is aligned with the front surface of the second rear beam portion 54 in the front-rear direction or disposed before the front surface of the second rear beam portion 54.

A plurality of second insertion holes 58 defined by the second retaining portions 57 are formed between the second front beam portion 53 and the second rear beam portion 54. The first retaining portion 27 is insertable into the second terminal accommodation chamber 46 through the second insertion hole 58.

A plurality of second insertion holes 58 are composed of a pair of second outer insertion holes 58X disposed on both lateral ends and a plurality of second inner insertion holes 58Y disposed between the pair of second outer insertion holes 58X. The second outer insertion holes 58X differ from the second inner insertion holes 58Y in having a smaller lateral width than the second inner insertion holes 58Y. The first one-side retaining portion 27X is insertable into the second outer insertion hole 58X, and the first both-side retaining portion 27Y is insertable into the second inner insertion hole 58Y. The second outer insertion hole 58X is so formed that one second terminal accommodation chamber 46 can be seen from below. Thus, one first one-side retaining portion 27X is insertable into one second terminal accommodation chamber 46 through the second outer insertion hole 58X. On the other hand, the second inner insertion hole 58Y is so formed that adjacent two second terminal accommodation chambers 46 can be seen from below. Thus, one first both-side retaining portion 27Y is insertable into adjacent two second terminal accommodation chambers 46 through the second inner insertion hole 58Y.

Each side plate portion 60 includes a rising portion 61 constituting most (front end part and central part in the front-rear direction) of the side plate portion 60 except a rear end part and the lock plate portion 62 constituting the rear end part of the side plate portion 60. The front end edge of each side plate portion 60 extends up to the front end edge of the second terminal accommodating portion 40. The rear end edge of each side plate portion 60 extends up to the rear end part (position slightly before the rear end edge of the second terminal accommodating portion 40) of the second terminal accommodating portion 40.

The rotary shaft bearing portion 66 for rotatably supporting the rotary shaft portion 30 of the first housing 2 is formed on a front end part of the inner side surface of each side plate portion 60. The rotary shaft bearing portion 66 is open forward and laterally inward and has a rear receiving surface 66A for restricting a rearward movement of the rotary shaft portion 30, an upper receiving surface 66B for restricting an upward movement of the rotary shaft portion 30 and an outer receiving surface 66C for restricting a laterally outward movement of the rotary shaft portion 30. The rear receiving surface 66A, the upper receiving surface 66B and the outer receiving surface 66C are continuous with each other. The upper receiving surface 66B extends along a substantially horizontal direction.

The lock plate portions 62 rise from the upper surfaces of rear end parts of both left and right end edges of the second terminal accommodating portion 40. The upper end edge of the lock plate portion 62 extends further upward than that of the rising portion 61. The lock plate portion 62 includes a protruding portion 63 rising from the upper surface of the rear end part of the left or right end edge of the second terminal accommodating portion 40 and a lock protrusion 64 projecting laterally inward from an upper end part of the lateral inner surface of the protruding portion 63. The protruding portion 63 is in the form of a flat plate thick in the lateral direction. The lateral outer side surface of the protruding portion 63 protrudes further laterally outward than that of the rising portion 61. The lateral inner side surface of the protruding portion 63 protrudes further laterally inward than that of the rising portion 61. The lock protrusion 64 is disposed above the upper end edge of the rising portion 61. The front end edge of the lock plate portion 62 is continuous with the rear end edge of the rising portion 61. The aforementioned second retaining portions 57 are located before the lock plate portions 62 and behind the second front wall portion 48 in the front-rear direction.

In this embodiment, an outer surface (lower surface) of the second base portion 45 in the stacking direction is defined as an outermost surface 45S. The second base portion 45 is formed with a continuous rib 70 projecting outward from the outermost surface 45S in the stacking direction. The continuous rib 70 is formed on a rear end part (behind the first retaining portions 27 and the second retaining portions 57) of the second base portion 45. The continuous rib 70 is disposed at a position not to enter the mating connector and exposed outside the mating connector when the connector 1 is connected to the mating connector (not shown). Thus, a height increase of the mating connector (not shown) is suppressed. A projecting end surface of the continuous rib 70 in the stacking direction is a flat surface along a horizontal direction.

The continuous rib 70 is composed of one detection rib 71, a pair of bilaterally symmetrical guide ribs 72 and one connection rib 73. The detection rib 71 is elongated in the front-rear direction and formed in a laterally central part of the second base portion 45. The detection rib 71 has a rectangular cross-sectional shape in a front view. The guide ribs 72 are elongated in the front-rear direction and formed on both left and right end edges of the second base portion 45. The guide rib 72 has a rectangular cross-sectional shape in a front view. The connection rib 73 is elongated in the lateral direction and formed along the rear end edge of the second base portion 45. The connection rib 73 is connected substantially at a right angle to a rear end part of the detection rib 71 and rear end parts of the guide ribs 72 on both left and right sides in a bottom view.

The front end edges of the detection rib 71 and the guide ribs 72 on the both left and right sides are aligned in the front-rear direction and are located behind the rear ends of the first and second retaining portions 27, 57. The detection rib 71 and the guide ribs 72 on the both left and right sides are disposed to overlap in a side view, and the detection rib 71 cannot be seen by being hidden behind the guide rib 72 in a side view in a state where the second base portion 45 is not deformed.

<Female Terminal Fitting 80>

Figure 13:
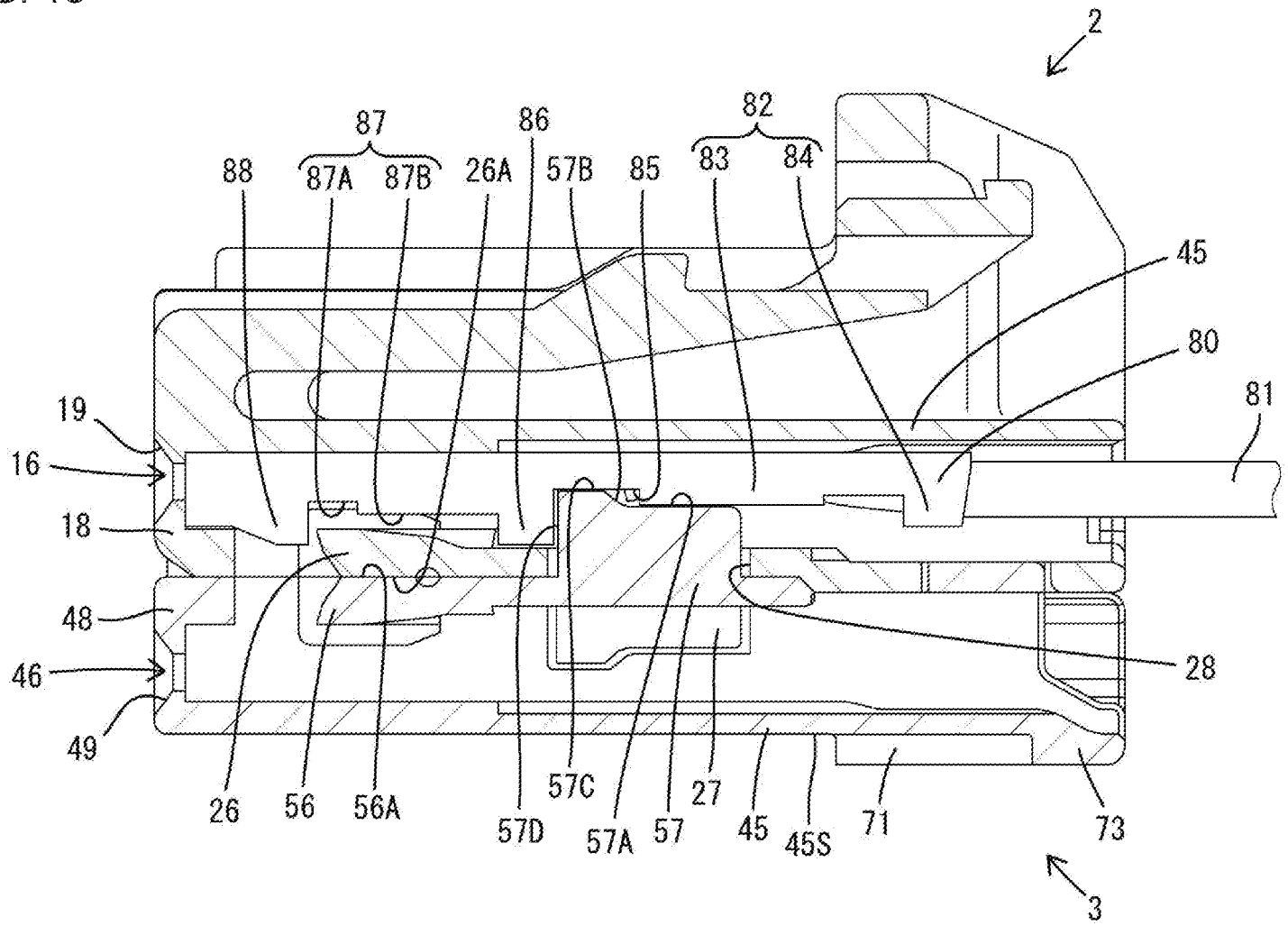
FIG. 13 is a section along A-A of FIG. 11 showing a state where the first and second housings are assembled without female terminal fittings and retaining portions interfering with each other.
Figure 14:
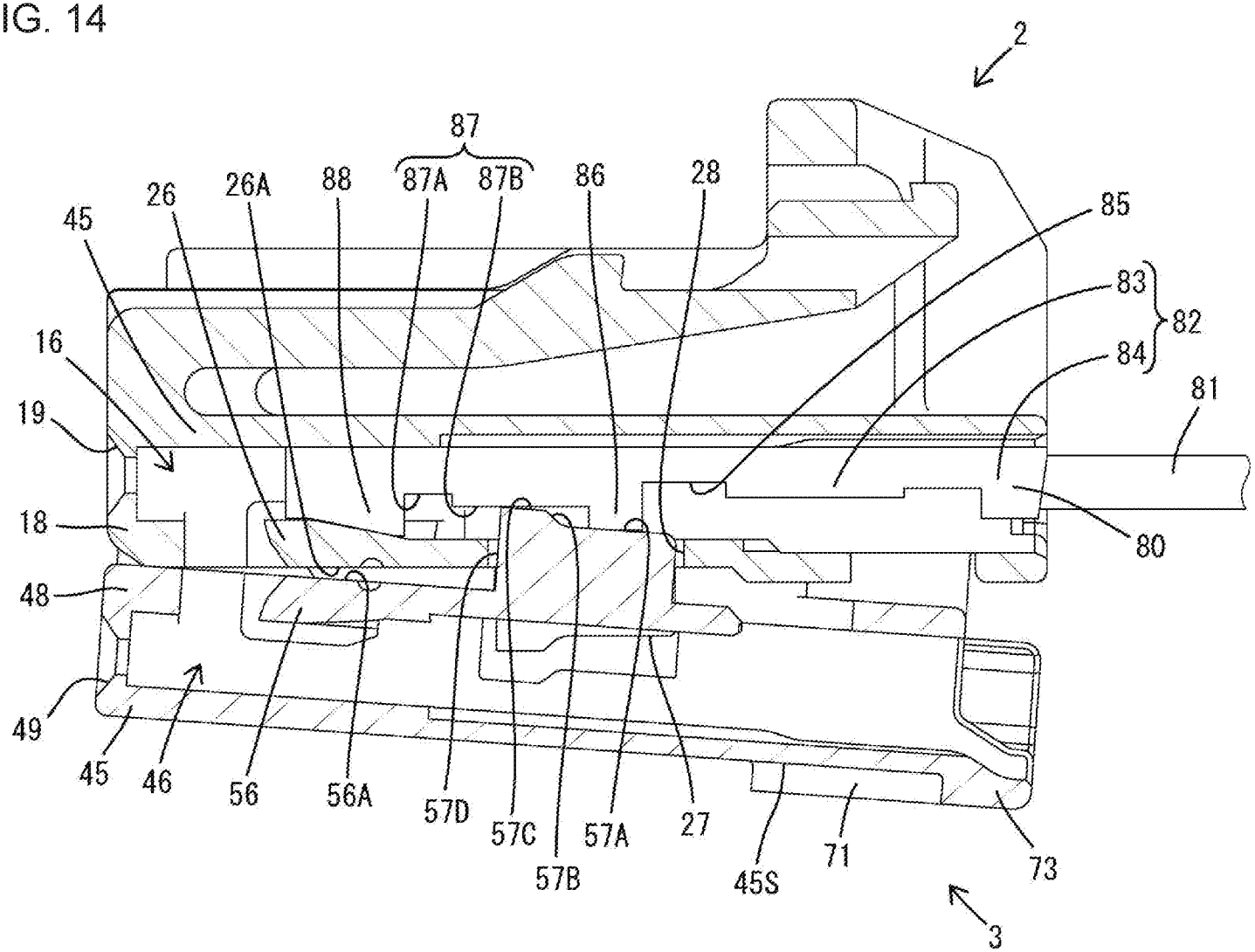
FIG. 14 is a section along A-A of FIG. 11 showing a state where the female terminal fitting and the retaining portion interfere with each other.

As shown in FIGS. 13 and 14, the female terminal fitting 80 is formed into a tubular shape elongated in the front-rear direction as a whole, such as by bending a conductive metal plate. A crimping portion 82 to be crimped to a wire 81 is formed on a rear end part of the female terminal fitting 80. The crimping portion 82 includes a wire barrel 83 to be crimped to a conductor exposed on the tip of the wire 81 and an insulation barrel 84 to be crimped to an insulation coating covering the outer periphery of the conductor. A part of the wire barrel 83 bent by crimping is retracted more inwardly in a height direction than the insulation barrel 84.

The female terminal fitting 80 is formed with a first groove portion 85 in front of the wire barrel 83, an inner tube portion 86 in front of the first groove portion 85, a second groove portion 87 in front of the inner tube portion 86 and a leading end tube portion 88 in front of the second groove portion 87. The first and second groove portions 85, 87 are formed by recessing a side, on which the crimping portion 82 is bent in the height direction by crimping, inwardly in the height direction with respect to the inner tube portion 86 and the leading end tube portion 88. A recessed part of the first groove portion 85 is retracted more inwardly in the height direction than the part of the wire barrel 83 bent by crimping.

The second groove portion 87 is formed in a stepped manner to become deeper toward the front and composed of a second front groove portion 87A on a front side with a larger groove depth and a second rear groove portion 87B on a rear side with a smaller groove depth. Further, the part of the wire barrel 83 bent by crimping and a part of the insulation barrel 84 bent by crimping are retracted more inwardly in the height direction than the inner tube portion 86 and the leading end tube portion 88.

<How to Assemble Connector>

The connector 1 is assembled as follows. First, the female terminal fittings 80 are inserted into each first terminal accommodation chamber 16 of the first housing 2 and each second terminal accommodation chamber 46 of the second housing 3. Each female terminal fitting 80 is inserted to a proper position. After an inserting operation is completed for all the female terminal fittings 80, the second housing 3 is assembled with the first housing 2. To that end, the rotary shaft portions 30 of the first housing 2 are fit into the rotary shaft bearing portions 66 of the second housing 3 from front. When the first housing 2 is rotated in a direction to overlap the second housing 3 with the rotary shaft portions 30 as rotary shafts, the inclined surfaces 32A of the lock receiving portions 32 of the first housing 2 come into contact with the lock protrusions 64 of the second housing 3. When the first and second housings 2, 3 are further moved in an overlapping direction from this state, the lock plate portions 62 including the lock protrusions 64 are deflected by being pressed laterally outward by the inclined surfaces 32A of the lock receiving portions 32. When the first and second housings 2, 3 are further moved in the overlapping direction and the lock protrusions 64 move over the slipping surfaces 32B of the lock receiving portions 32, the lock protrusions 64 are no longer interfered with by the lock receiving portions 32 and return to an initial shape by resilient restoring forces of the lock plate portions 62 and movements thereof in a separating direction are restricted by the receiving surfaces 32C of the lock receiving portions 32. In this locked state, not only the receiving surfaces 32C are caught by the lock protrusions 64, but also the rotary shaft portions 30 are caught by the rotary shaft bearing portions 66. Note that, in the following description, a lock portion constituted by the rotary shaft portions 30 and the rotary shaft bearing portions 66 is referred to as a first lock portion, and a lock portion constituted by the lock protrusions 64 and the lock receiving portions 32 is referred to as a second lock portion.

The separation of the first and second housings 2, 3 is restricted by the locking of the first and second lock portions. Further, in the locked state, the first housing 2 is fit into a space between the side plate portions 60 on the both left and right sides of the second housing 3. In this way, a lateral movement of the first housing 2 with respect to the second housing 3 is restricted.

Further, a rearward movement of the first housing 2 with respect to the second housing 3 is restricted by the locking of the first lock portion. Specifically, if the first housing 2 is going to move rearward, the rotary shaft portions 30 come into contact with the rotary shaft bearing portions 66 of the second housing 3, thereby restricting a rearward movement of the first housing 2 with respect to the second housing 3.

Further, a forward movement of the first housing 2 with respect to the second housing 3 is restricted by the locking of the second lock portion. Specifically, if the first housing 2 is going to move forward, the rotary shaft portions 30 come into contact with the rear surfaces of the fitting groove portions 31, thereby restricting a forward movement of the first housing 2 with respect to the second housing 3. Further, the lock protrusions 64 come into contact with the rear end ribs 34 of the first housing 2 to restrict a forward movement of the first housing 2 with respect to the second housing 3. A state where the first housing 2 and the second housing 3 are locked by the first and second lock portions as just described is defined as the locked state. Note that the first and second lock portions are equivalent to a "holding portion" of the present invention. In this locked state, the housings 2, 3 are held in a stacked state.

<Detection of Incompletely Inserted State>

The female terminal fitting 80 may not contact a mating terminal fitting (not shown) with the connector 1 and the mating connector (not shown) connected in an incompletely inserted state before the female terminal fitting 80 reaches a proper position in the first terminal accommodation chamber 16 or the second terminal accommodation chamber 46. Accordingly, in this embodiment, the incompletely inserted state can be detected as follows. Note that although a state where the female terminal fitting 80 is inserted in the first terminal accommodation chamber 16 is shown here for the convenience of description, the same applies also in the case of inserting the female terminal fitting 80 into the second terminal accommodation chamber 46.

First, a case where the first and second housing 2, 3 are locked to each other in a properly inserted state where the female terminal fittings 80 are inserted to the proper positions is described. When the female terminal fitting 80 is inserted into the first terminal accommodation chamber 16, the first locking lance 26 is pressed by a front end part (leading end tube portion 88) of the female terminal fitting 80 to be deflected toward a side opposite to the first terminal accommodation chamber 16. When the female terminal fitting 80 is inserted to the proper position, the first locking lance 26 resiliently returns and is accommodated in the second groove portion 87. In this way, the first locking lance 26 comes into contact with the front end surface of the second groove portion 87 of the female terminal fitting 80 trying to move rearward, wherefore a rearward movement of the female terminal fitting 80 is restricted. At this time, the inner tube portion 86 of the female terminal fitting 80 is disposed on a front side of an opening area of the first insertion hole 28.

When the first and second housings 2, 3 having reached the properly inserted state in this way are locked to each other by the first and second lock portions, the following state is achieved as shown in FIG. 13. The first and second locking lances 26, 56 are in a back-to-back state where the first and second back contact surfaces 26A, 56A overlap each other. In this way, a movement of the first locking lance 26 toward the side opposite to the first terminal accommodation chamber 16 is restricted by the second locking lance 56.

Further, the second retaining portion 57 is inserted into the first terminal accommodation chamber 16 through the first insertion hole 28 and accommodated into the first groove portion 85 without interfering with the female terminal fitting 80. More specifically, the second interfering rear surface 57A is disposed along the part of the wire barrel 83 bent by crimping, and the second interfering front surface 57C is disposed along the back end surface of the first groove portion 85 of the female terminal fitting 80. The second restricting surface 57D of the second retaining portion 57 comes into contact with the back surface of the inner tube portion 86 in the female terminal fitting 80 trying to move rearward, thereby restricting a rearward movement of the female terminal fitting 80. In this way, the first and second housings 2, 3 are held in the stacked state without the second retaining portions 57 and the female terminal fittings 80 interfering with each other.

In contrast, with the female terminal fitting 80 incompletely inserted, the inner tube portion 86 of the female terminal fitting 80 is located in the opening area (i.e. in the space into which the second retaining portion 57 is to be inserted) of the first insertion hole 28 as shown in FIG. 14. If it is attempted to lock the first and second housings 2, 3 to each other in this state, the second retaining portion 57 inserted into the first insertion hole 28 interferes with the inner tube portion 86 of the female terminal fitting 80. Thus, if the incompletely inserted female terminal fitting 80 is present near the left or right end part of the connector 1, the first housing 2 (lock receiving portion 32) cannot be locked to the second housing 3 (lock plate portion 62).

Further, if the incompletely inserted female terminal fitting 80 is present in a laterally central part (position distant from the lock receiving portions 32 and the lock plate portions 62 in the lateral direction) of the connector 1, the first housing 2 (lock receiving portions 32) and the second housing 3 (lock plate portions 62) can be locked by catching each other. However, the second base portion 45 of the second housing 3 is resiliently curved and deformed such that a laterally central part of the outermost surface 45S thereof protrudes downward. Associated with this, the detection rib 71 protrudes downward. Specifically, the lower surface of the detection rib 71 protrudes further downward than the lower surfaces of the guide ribs 72. Thus, the presence or absence of the incompletely inserted state can be confirmed by visually confirming whether or not the detection rib 71 is protruding downward.

Figure 15A:
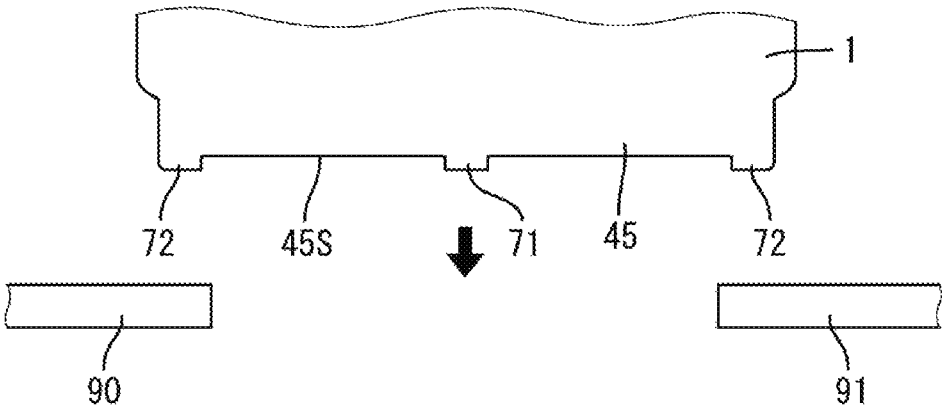
FIGS. 15(A), 15(B) and 15(C) are diagrams showing a state where the presence or absence of an incompletely inserted state is checked using a checking tool for the connector assembled with the terminal fittings inserted to proper positions.
Figure 15B:
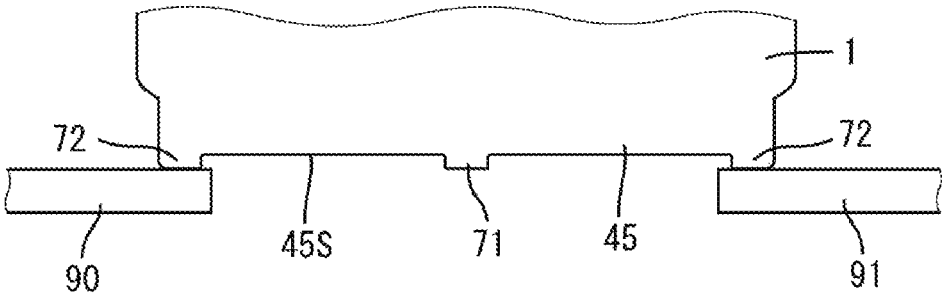
Figure 15C:
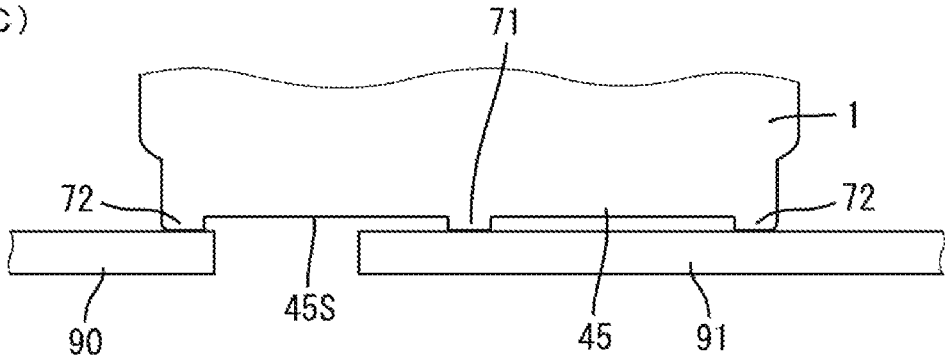
Figure 16A:
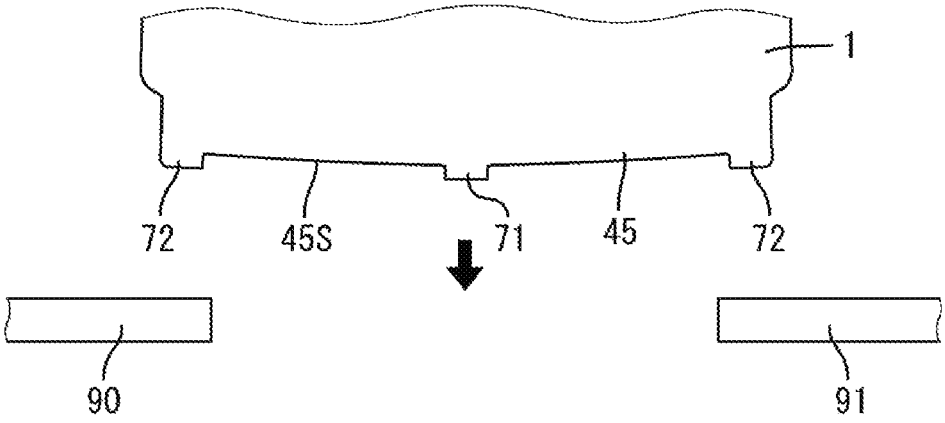
FIGS. 16(A), 16(B) and 16(C) are diagrams showing a state where the presence or absence of the incompletely inserted state is checked using the checking tool for the connector assembled with the terminal fitting left at an incompletely inserted position.
Figure 16B:
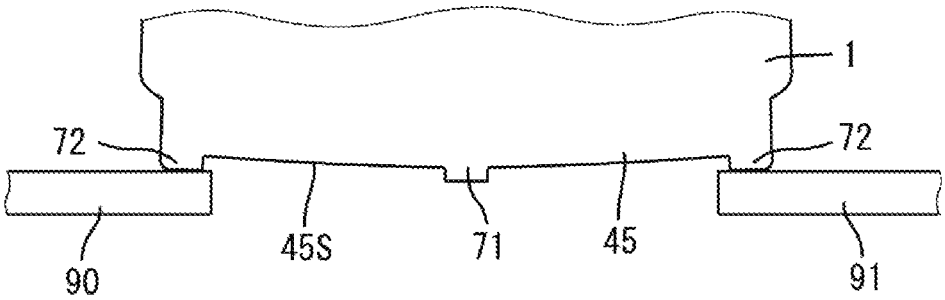
Figure 16C:
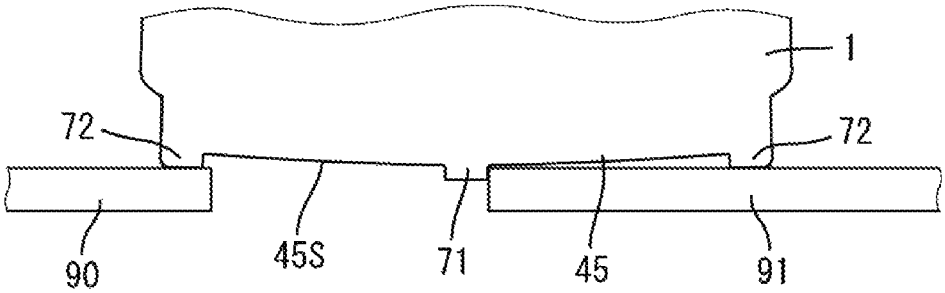

Further, whether or not the detection rib 71 is protruding downward can also be detected using a checking tool 91 as described below. To detect whether or not the detection rib 71 is protruding downward, a fixed pedestal 90 and the horizontally movable checking tool 91 are used as shown in FIGS. 15 and 16. The checking tool 91 is disposed at a position horizontally facing the pedestal 90 and movable toward and away from the pedestal 90. Note that the checking tool 91 is disposed at a standby position in a state before checking is started.

In checking, one guide rib 72, out of the guide ribs 72 on the both left and right ends of the connector 1 to be checked, is placed on the upper surface of the pedestal 90 and the other guide rib 72 is placed on the upper surface of the checking tool 91. Then, the checking tool 91 is slid in contact with the guide rib 72 and moved forward to a checking position toward the pedestal 90. The checking position needs to be set on a vertical extension of the detection rib 71 or closer to the pedestal 90 than this extension.

When the female terminal fittings 80 are in a properly inserted state, the lower surface of the detection rib 71 is aligned with the lower surfaces of the guide ribs 72 in the vertical direction or disposed above the lower surfaces of the guide ribs 72 as shown in FIG. 15. Thus, the checking tool 91 reaches the checking position after passing below the detection rib 71. In this way, it can be detected that all the female terminal fittings 80 in the connector 1 are in the properly inserted state.

In contrast, if the female terminal fitting 80 disposed in a laterally central area is in the incompletely inserted state, the lower surface of the detection rib 71 protrudes further downward than those of the guide ribs 72 as shown in FIG. 16. Thus, the checking tool 91 comes into contact with the detection rib 71 and does not reach the checking position. In this way, it can be detected that there is any female terminal fitting 80 in the incompletely inserted state in the connector 1.

<Functions and Effects of Embodiment>

As described above, the connector 1 of this embodiment includes the first housing 2 having the first base portion 15 in the form of a flat plate and the second housing 3 having the second base portion 45 in the form of a flat plate. The first and second housings 2, 3 are assembled in the state stacked one on the other. The first housing 2 is formed with the first terminal accommodation chambers 16 for accommodating the plurality of female terminal fittings 80 in parallel in the lateral direction along the first base portion 15. The second housing 3 is formed with the second terminal accommodation chambers 46 for accommodating the plurality of female terminal fittings 80 in parallel in the lateral direction along the second base portion 45. The connector 1 includes the first and second lock portions for holding the first and second housings 2, 3 in the state stacked one on the other. The first housing 2 includes the first retaining portions 27 for preventing the rearward escape of the female terminal fittings 80 accommodated in the second terminal accommodation chambers 46. The second housing 3 includes the second retaining portions 57 for preventing the rearward escape of the female terminal fittings 80 accommodated in the first terminal accommodation chambers 16. The second housing 3 includes the detection rib 71 disposed in the laterally central part and projecting downward from the lower surface of the second base portion 45. The detection rib 71 protrudes outward in the stacking direction due to outward deflection of the second base portion 45 formed with the detection rib 71 in the stacking direction when the female terminal fitting 80 in the incompletely inserted state and the retaining portion 27, 57 interfere with each other.

In the connector 1, if it is attempted to assemble the first and second housings 2, 3 with each other with the female terminal fitting 80 left in the incompletely inserted state, the female terminal fitting 80 in the incompletely inserted state and the retaining portion 27, 57 of the housing 2, 3 overlapping the housing 3, 2 accommodating this female terminal fitting 80 interfere with each other. Thus, if the female terminal fitting 80 is incompletely inserted near the first or second lock portion, the housings 2, 3 cannot catch each other due to the interference of the female terminal fitting 80 and the retaining portion 27, 57. On the other hand, if the female terminal fitting 80 is incompletely inserted at a position distant from the first and second lock portions, the housings 2, 3 can be held in the stacked state by catching each other. However, in this case, the second base portion 45 is deflected downward due to the interference of the female terminal fitting 80 and the retaining portion 27, 57. Thus, the detection rib 71 protrudes downward as compared to the case where the female terminal fitting 80 and the retaining portion 27, 57 do not interfere. Therefore, whether or not any female terminal fitting 80 is in the incompletely inserted state can be confirmed by visually confirming whether or not the detection rib 71 is protruding, using the checking tool 91 and the like.

Further, the second housing 3 is provided with the front wall portion 48 in the form of a rib rising from the front edge part of the second base portion 45 and configured to restrict forward movements of the female terminal fittings 80 accommodated in the second terminal accommodation chambers 46. The detection rib 71 is provided on the rear end part of the second base portion 45.

Accordingly, the front end part of the second base portion 45 has high rigidity. In contrast, the rear end part of the second base portion 45 has lower rigidity than the front end part and is easily deflected. By providing the detection rib 71 at this easily deflected position, improper deformation and the like of the female terminal fitting 80 and the retaining portion 27, 57 during interference can be prevented.

The second housing 3 is provided with the guide ribs 72 projecting downward from the both left and right end edges of the lower surface of the second base portion 45. The lower surfaces of the guide ribs 72 are aligned with that of the detection rib 71 in the vertical direction or located below that of the detection rib 71.

As described above, if the housings 2, 3 are caught by each other with the female terminal fitting 80 left incompletely inserted, the second base portion 45 is deflected downward. At this time, since the second housing 3 is deflected with the first and second lock portions as supporting points, the second base portion 45 is less easily deflected at positions close to the first and second lock portions and more easily deflected at positions distant from the first and second lock portions. Here, in the connector 1, the detection rib 71 is provided at the easily deflected position and the guide ribs 72 are provided at difficult-to-deflect positions on the second base portion 45. The lower surfaces of the guide ribs 72 are aligned with that of the detection rib 71 or disposed below that of the detection rib 71. Thus, if the second base portion 45 is not deflected, the lower surface of the detection rib 71 does not protrude further downward than the lower surfaces of the guide ribs 72. In contrast, if the second base portion 45 is deflected due to the interference of the female terminal fitting 80 and the retaining portion 27, 57, the lower surface of the detection rib 71 protrudes further downward than those of the detection ribs 72. Thus, if the checking tool 91 is horizontally moved toward the detection rib 71 while sliding on the lower surface of the guide rib 72, the checking tool 91 comes into contact with the detection rib 71 if the female terminal fitting 80 is incompletely inserted, whereas the checking tool 91 does not come into contact with the detection rib 71 if none of the female terminal fittings 80 is incompletely inserted. By using the lower surfaces of the guide ribs 72 as a reference position in this way, the incompletely inserted state of the female terminal fitting 80 can be easily and precisely detected.

The invention is not limited to the above described embodiment. For example, the following embodiments also are included in the scope of the invention.

In the above embodiment, the locks are provided on the both left and right sides of the connector. However, the lock may be provided only on one of the left and right end sides of the connector or may be provided at a position other than the left and right end sides (i.e. laterally central part).

Although two locks, i.e. the first and second locks, are provided in the above embodiment, either one of these may be provided. Specifically, although the connector is locked over the entire width in the front-rear direction on the left and right sides, the connector may be locked partially in the front-rear direction.

The connection rib may be omitted. Further, the guide ribs may be omitted.

LIST OF REFERENCE SIGNS

1 . . . connector
2 . . . first housing (housing)
3 . . . second housing (housing)
10 . . . first terminal accommodating portion
15 . . . first base (base)
16 . . . first terminal accommodation chamber (terminal accommodation chamber)
18 . . . first front wall
27 . . . first retaining portion (retaining portion)
30 . . . rotary shaft (part of holding portion)
31 . . . fitting groove (part of holding portion)
32 . . . lock receiving portion (part of holding portion)
40 . . . second terminal accommodating portion
45 . . . second base (base)
45S . . . outermost surface
46 . . . second terminal accommodation chamber (terminal accommodation chamber)
48 . . . second front wall (front wall)
57 . . . second retaining portion (retaining portion)
64 . . . lock protrusion (part of holding portion)
66 . . . rotary shaft bearing portion (part of holding portion)
70 . . . continuous rib
71 . . . detection rib
72 . . . guide rib
73 . . . connection rib
80 . . . female terminal fitting (terminal fitting)
91 . . . checking tool

What is claimed is:

1. A connector, comprising:

a plurality of housings each including a base in the form of a flat plate, opposite front and rear ends and opposite first and second lateral sides extending between the front and rear ends, the housings being assembled in a stacked state;

terminal accommodating chambers extending through the housings from the rear end to the front end and configured to accommodate terminal fittings in parallel in a width direction along the base;

first and second holding portions at the respective first and second lateral sides and being configured to hold the housings in the stacked state;

retaining portions provided in at least one of the housings and configured to prevent the escape of the terminal fittings inserted into another housing overlapping in the stacked state; and a detection rib disposed at a position spaced laterally inward from the first and second holding portions in an arrangement direction of the terminal fittings and projecting out in a stacking direction from an outermost surface in the stacking direction of the base of the outermost housing in the stacking direction;

the base formed with the detection rib being deflected outward in the stacking direction in response to interference between an incompletely inserted terminal fitting and the corresponding retaining portion, and the outward deflection of the base causing the detection rib to protrude out in the stacking direction and into a position where the outward protruding detection rib is detectable.

2. The connector of claim 1, wherein:

the outermost housing in the stacking direction is formed with a front wall in the form of a rib rising from a front part of the base and configured to restrict forward movements of the terminal fittings accommodated in the terminal accommodation chambers; and the detection rib is provided on a rear end part of the base.

3. The connector of claim 2, wherein:

the base of the outermost housing is formed with a guide rib disposed substantially on an extension of the holding portion in the stacking direction and projecting outward in the stacking direction from the outermost surface; and a projecting end surface of the guide rib in the stacking direction is aligned in the stacking direction with a projecting end surface of the detection rib in the stacking direction or located farther out in the stacking direction than the projecting end surface of the detection rib in the stacking direction.

4. The connector of claim 1, wherein the detection rib is in a laterally central part of the outermost housing and substantially centrally between the first and second lateral sides.

5. The connector of claim 1 wherein the detection rib extends substantially in a front-rear direction of the outermost housing.

6. The connector of claim 1, further comprising a connection rib extending laterally across the outermost surface and at a position adjacent the rear end, the detection rib projecting forward from a substantially laterally central part of the connection rib, first and second guide ribs projecting forward from the connection rib at a positions adjacent the respective first and second sides.

7. A connector, comprising:

a plurality of housings each including a base in the form of a flat plate, the housings being assembled in a stacked state;

terminal accommodating chambers formed in the housings and configured to accommodate terminal fittings in parallel in a width direction along the base;

a holding portion configured to hold the housings in the stacked state;

retaining portions provided in at least one of the housings and configured to prevent the escape of the terminal fittings inserted into another housing overlapping in the stacked state; and a detection rib disposed at a position distant from the holding portion in an arrangement direction of the terminal fittings and projecting out in a stacking direction from an outermost surface, the outermost surface being an outer surface in the stacking direction of the base of the outermost housing in the stacking direction;

the detection rib protruding out in the stacking direction by the base portion formed with the detection rib being deflected outward in the stacking direction when the terminal fitting in an incompletely inserted state and the retaining portion interfere with each other wherein:

the base of the outermost housing is formed with a guide rib disposed substantially on an extension of the holding portion in the stacking direction and projecting outward in the stacking direction from the outermost surface; and a projecting end surface of the guide rib in the stacking direction is aligned in the stacking direction with a projecting end surface of the detection rib in the stacking direction or located farther out in the stacking direction than the projecting end surface of the detection rib in the stacking direction.

* * * * *